US005414986A

United States Patent [19]

Landmesser

[11] Patent Number: 5,414,986

[45] Date of Patent: May 16, 1995

[54] METHOD AND APPARATUS FOR SUPPLYING SLIVER TO THE SPINNING STATIONS OF SPINNING MACHINES IN THE FORM OF A TRANSPORT-CONTAINERLESS BUNCH

[75] Inventor: Paul Landmesser, Erkelenz, Germany

[73] Assignee: W. Schlafhorst AG & Co., Moenchengladbach, Germany

[21] Appl. No.: 68,242

[22] Filed: May 27, 1993

[30] Foreign Application Priority Data

May 30, 1992 [DE] Germany ..... 42 17 981.5

[51] Int. Cl.[6] ..... D01H 9/10; D01H 9/00

[52] U.S. Cl. ..... 57/281; 19/159 A; 57/90; 57/266; 57/268; 57/270

[58] Field of Search ..... 19/159 A, 243, 0.25, 19/0.21, 157; 57/266, 268, 270, 281, 352, 90; 242/131; 414/417

[56] References Cited

U.S. PATENT DOCUMENTS

| | | | |
|---|---|---|---|
| 1,727,764 | 9/1929 | Gibbs | 19/157 |
| 3,511,045 | 5/1970 | Bures et al. . | |
| 3,698,174 | 10/1972 | Boucek et al. | 57/58.95 |
| 4,150,534 | 4/1979 | Raasch | 57/281 |
| 4,268,210 | 5/1981 | Ferguson et al. | 414/417 X |
| 4,468,165 | 8/1984 | Kawasaki | 414/417 |
| 4,939,895 | 7/1990 | Raasch et al. | 57/263 |
| 5,138,828 | 8/1992 | Stahlecker | 57/281 |
| 5,172,541 | 12/1992 | Schmalz | 57/281 |

FOREIGN PATENT DOCUMENTS

| | | | |
|---|---|---|---|
| 63306 | 8/1968 | Germany . | |
| 2062768 | 9/1980 | Germany . | |
| 1815776 | 7/1982 | Germany . | |
| 8812622 | 2/1990 | Germany . | |
| 40180881 | 1/1991 | Germany . | |
| 1193379 | 9/1967 | United Kingdom | 19/159 A |
| 4015938 | 11/1991 | United Kingdom . | |

*Primary Examiner*—Daniel P. Stodola
*Assistant Examiner*—William Stryewski
*Attorney, Agent, or Firm*—Herbert L. Lerner; Laurence A. Greenberg

[57] ABSTRACT

An apparatus for supplying the spinning machine with feed material includes a transport unit being movable along the spinning machine for advancing feed material produced by a production machine upstream of the textile machine to a region of the spinning stations. The transport unit has at least one pusher for transferring the feed material in the form of a transport-containerless bunch, to the feed stations.

23 Claims, 3 Drawing Sheets

METHOD AND APPARATUS FOR SUPPLYING SLIVER TO THE SPINNING STATIONS OF SPINNING MACHINES IN THE FORM OF A TRANSPORT-CONTAINERLESS BUNCH

BACKGROUND OF THE INVENTION

1. Field of the Invention

The invention relates to a method and to an apparatus for supplying textile machines with feed material, particularly for furnishing sliver to the spinning stations of spinning machines, wherein the sliver, which is produced by an upstream production machine, is advanced by a transport unit that is movable along the spinning machine, to the region of the spinning stations and is transferred to feed stations provided at the spinning stations.

Supplying the spinning stations of open-end spinning machines, for example, with feed sliver that is stored in spinning cans with round cross sections, is known. The round cans are brought by a transport vehicle that picks up the containers at a charging station of an upstream production machine, for example from a drawing frame or a card. Since the diameter of such round cans is greater than the width of the spinning stations at which the sliver material is processed further, the spinning cans must be set up in at least two rows disposed one after the other in the regions of the spinning stations.

Since spinning cans that have run empty must be replaced with spinning cans having new feed material as fast as possible, the "random exchange" system is used. The automatic changing process known as "empty can out, full can in" is quite complicated, particularly when the change is to be carried out automatically and the can to be changed is located in the rear row.

2. Description of the Related Art

Attempts have therefore already been made in the past to simplify such a can changing process.

German Petty Patent G 88 12 622 and German Published, Non-Prosecuted Applications DE 40 15 938 A1 and DE 40 18 088 A1, for instance, describe the use of flattened spinning cans. The widths of such spinning cans are adapted to the width of the spinning stations of the spinning machine in question, in order to allow all of the spinning cans equipped with feed material to be positioned side by side, so that a second, rear row of spinning cans can be avoided. The use of such flattened spinning cans having the same width as the spinning stations has indeed lead to a simplification in the can changing process in the region of the spinning stations. However, it does not avoid a further considerable disadvantage of such feed material transport systems, which is that full or empty spinning cans are moved back and forth constantly between the preparation machines (card or drawing frame) and the spinning machines.

German Patent DE 18 15 776 C2, corresponding to U.S. Pat. No. 3,511,045; German Published, Prosecuted Application DE-AS 20 62 768, corresponding to U.S. Pat. No. 3,698,174; and East German Patent DD-PS 63 306, also disclose spinning machines in which the feed sliver is fed in "canlessly". The feed material is present in such spinning machines in the form of a sliver bobbin.

It is accordingly an object of the invention to provide a method and an apparatus for supplying sliver to the spinning stations of spinning machines, which overcome the hereinafore-mentioned disadvantages of the heretofore-known methods and devices of this general type and which provide a further-simplified and markedly more-efficient supply of feed material, such as sliver, to spinning stations.

SUMMARY OF THE INVENTION

With the foregoing and other objects in view there is provided, in accordance with the invention, a method for supplying textile machines with feed material, particularly for furnishing sliver to spinning stations of spinning machines, which comprises advancing feed material to a region of spinning stations of a spinning machine with a transport unit being movable along the spinning machine downstream of a production machine producing the feed material; and transferring the feed material as a bunch to feed stations at the spinning stations with the transport unit without an otherwise usual transport container.

With the objects of the invention in view, there is also provided, in combination with a spinning machine having spinning stations and feed stations at the spinning stations, an apparatus for supplying the spinning machine with feed material, particularly for furnishing sliver to the spinning stations, comprising a transport unit being movable along the spinning machine for advancing feed material produced by a production machine upstream of the textile machine to a region of the spinning stations; the transport unit having at least one pusher for transferring the feed material brought in the form of a transport-containerless bunch, directly to the feed stations.

In accordance with another feature of the invention, there are provided support surfaces on the transport unit for stabilizing the bunch during transport.

In accordance with a further feature of the invention, there are provided similar support surfaces in the region of the spinning stations at the feed stations.

In accordance with an added feature of the invention, on the transport unit, the support surfaces encompass the bunch except for a discharge opening.

In accordance with an additional feature of the invention, the support surfaces are disposed at the feed stations of the spinning station and likewise surround the bunch except for a charging opening.

In accordance with yet another feature of the invention, the transport unit has a plurality of supply containers formed by support surfaces, preferably 5 to 10 of them, which have an approximately U-shaped outline, and similar feed containers with a U-shaped outline are also provided in the region of the feed stations of the spinning stations. Since the open ends of these containers are oriented toward one another, the bunches being brought can easily be reloaded from the supply containers to the feed containers. The width of these containers is selected to be such that it does not exceed the width of the corresponding spinning stations.

In accordance with yet a further feature of the invention, in an alternative embodiment, the supply containers or feed containers have a substantially rectangular outline. The decisive factor is that once again the width of the containers does not exceed the width of the spinning stations.

Since the discharge openings of the supply containers and the charge openings of the feed containers are oriented toward one another and have the same inside cross section, the bunches can easily be transferred from the supply containers into the feed containers by a pusher disposed on the transport container.

In accordance with yet an added feature of the invention, each supply container is assigned its own pusher, which reaches under the bunch with a shovel-like blade, lifts it and pushes it out into the feed container.

In accordance with yet an additional feature of the invention, during the retraction of the pusher, the support element is lowered into a depression in the region of the bottom of the feed container.

In accordance with again another feature of the invention, there are provided suction devices on the feed containers, which automatically remove sliver residues from the feed containers.

In accordance with again a further feature of the invention, there are provided devices on the feed containers for holding the sliver end ready.

In accordance with again an added feature of the invention, the pushers have manipulators for transferring the sliver end during the transfer of the bunch from the supply containers to the feed containers.

In accordance with a concomitant feature of the invention, the containers are clean of yarn on their inner surfaces. This is done in order to avoid damage to the relatively vulnerable sliver during the transfer from one container to another and during the charging or discharging of the containers.

Other features which are considered as characteristic for the invention are set forth in the appended claims.

Although the invention is illustrated and described herein as embodied in a method and an apparatus for supplying sliver to the spinning stations of spinning machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
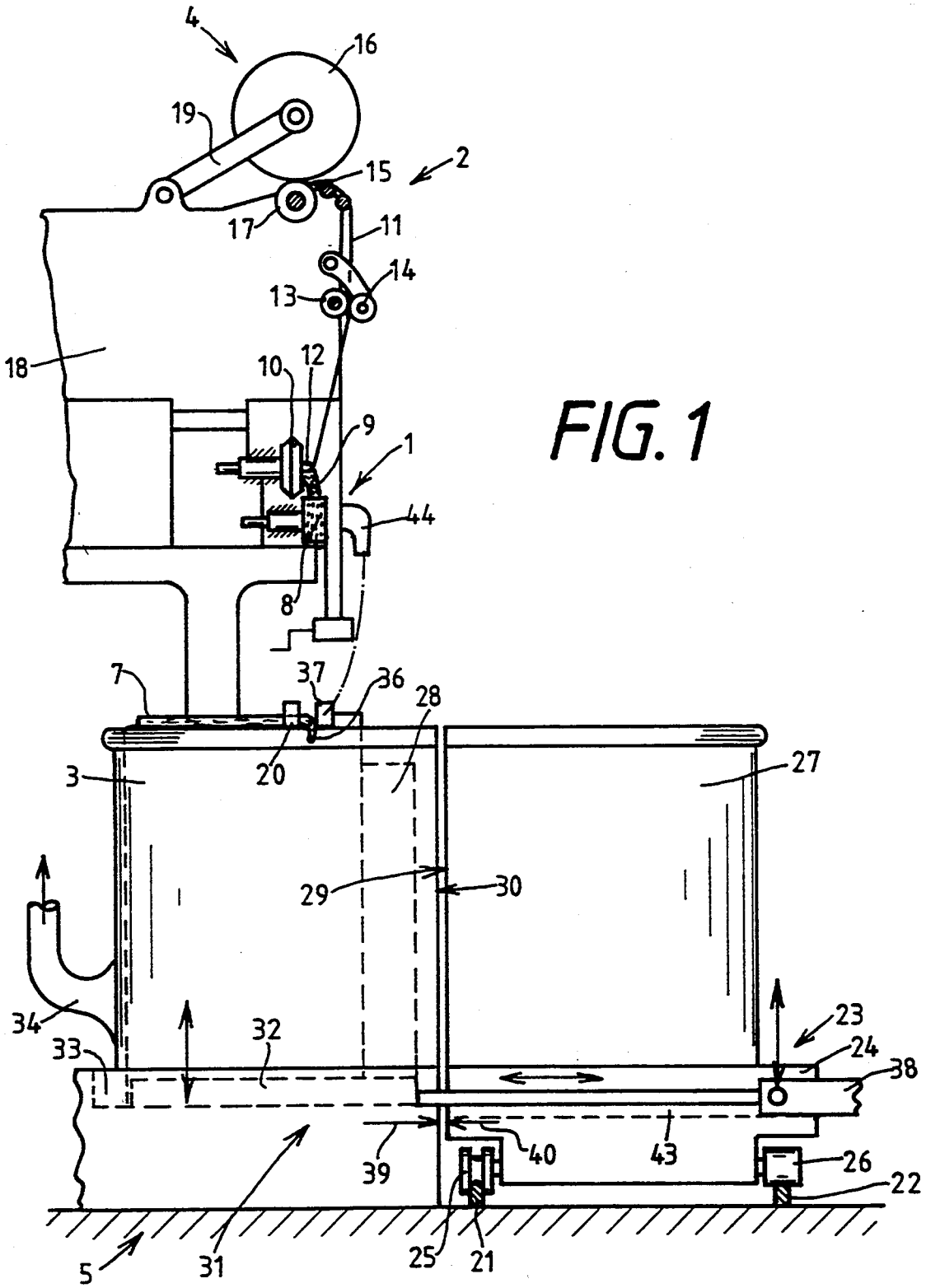
FIG. 1 is a fragmentary, diagrammatic, side-elevational view of a spinning station of an open-end spinning machine, which has a U-shaped feed container and a transport unit positioned in front of the spinning station, with a likewise U-shaped supply container during the transfer of feed material.
Figure 2:
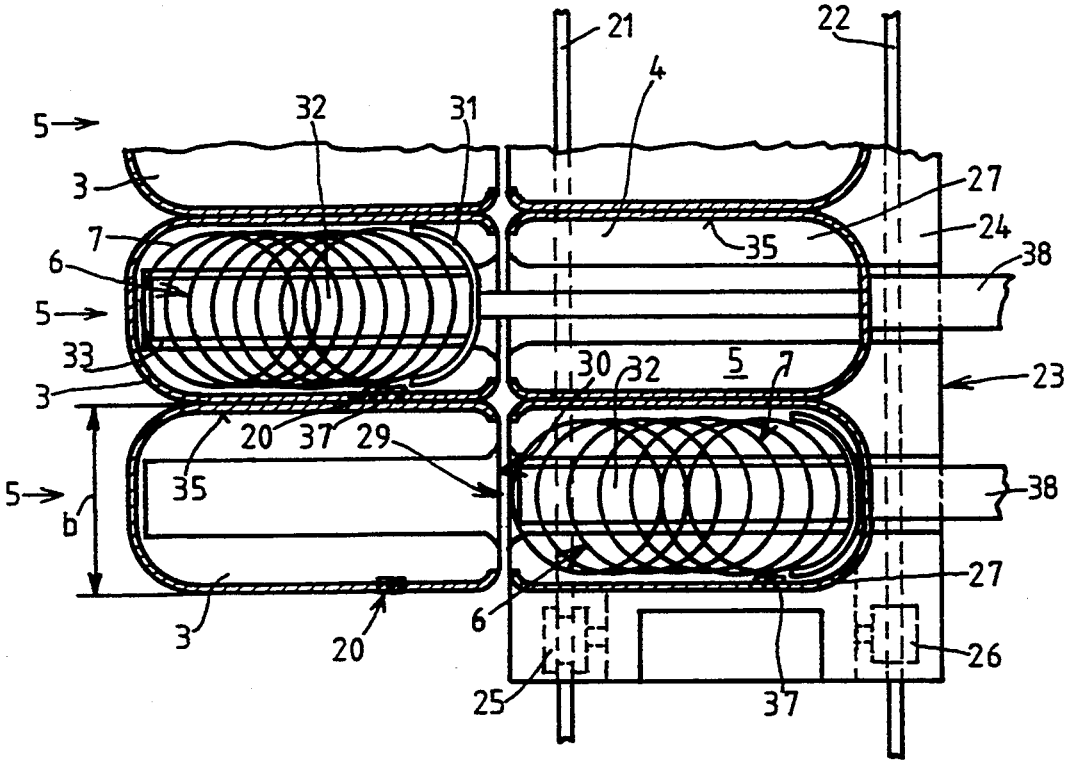
FIG. 2 is a fragmentary, plan view of U-shaped feed containers and a transport unit with corresponding supply containers.
Figure 3:
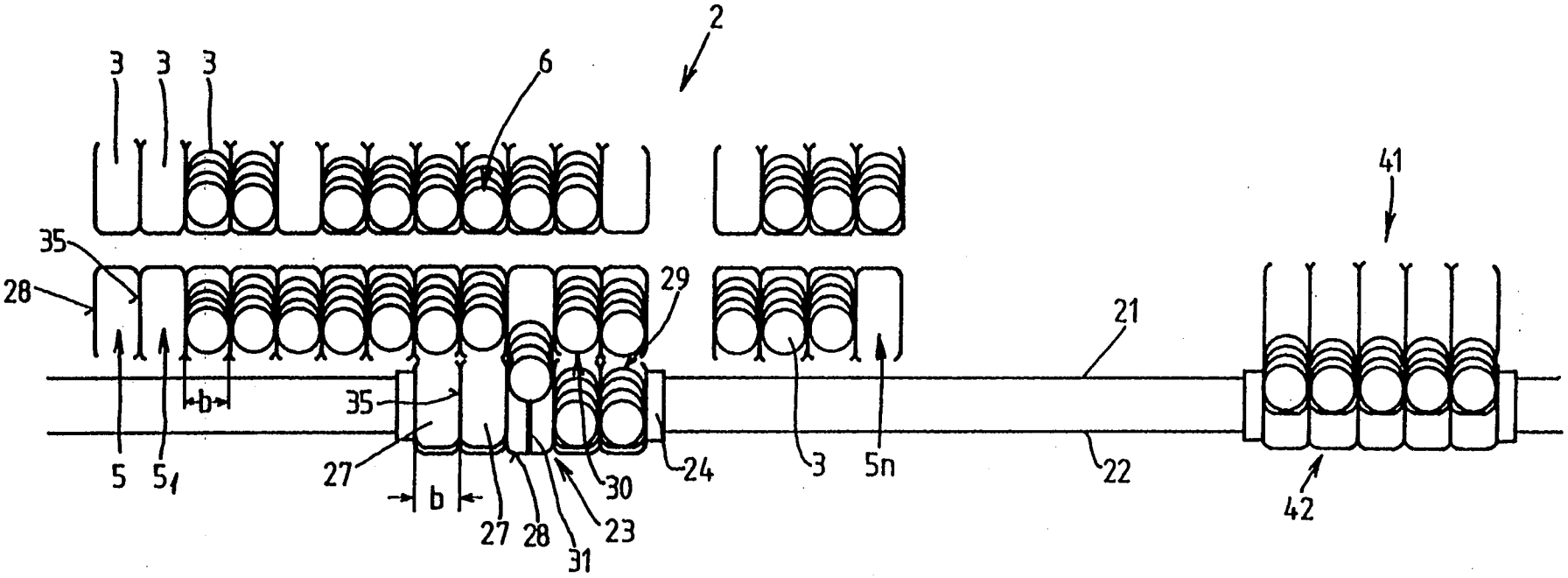
FIG. 3 is a fragmentary, diagrammatic, plan view of the entire system.

Referring now to the figures of the drawing in detail and first, particularly, to FIG. 1 thereof, there is seen a spinning station 1 of an open-end spinning machine 2. Spinning machines of this kind have many such spinning stations 1 located next to one another. A feed container 3 is permanently installed beneath the spinning station 1, in the region of a feed station 5. A multiplicity of feed stations 5, $5_1$ . . . $5_n$ are seen in FIG. 3. Feed material, which as a rule is a bunch 6 of sliver 7, is located in the feed container 3, as is also seen in FIG. 2. The feed material is produced by a production machine upstream of the textile machine. As is well-known and therefore as will only be explained briefly, the sliver 7 is first delivered to a separator 8 and then passes through a sliver channel 9 into a rotor 10. A yarn 11 produced in the rotor 10 travels through a draw-off tube 12, past a draw-off roller 13 and a spreader roller 14, over a yarn guide 15 and to a bobbin winding unit 4, where it is wound into a cross-wound bobbin 16 or cheese. As usual, the winding unit 4 includes a bobbin carrier 19 which is pivotably supported on a machine frame 18, and a drive roller 17 on which the cheese 16 rests.

The feed containers 3 that are installed in the region of the feed stations 5 advantageously have an approximately U-shaped outline, as is shown particularly in FIGS. 2 and 3, with an open end 30 oriented outward or in other words toward the side facing away from the machine.

The feed containers 3 are also assigned a suction device 34 and a sliver retainer 20. In the region of the bottom of the feed containers 3, a depression 33 is provided for receiving a support element in the form of a shovel-like blade 32 of a pusher 31.

Inner surfaces 35 of the feed containers 3 are also made clean of yarn.

Rails 21, 22 are laid in front of the open-end spinning station 2, so that a transport unit 23 can be driven over them. The transport unit 23 is a driverless conveyance which has a stable chassis 24 with a running gear as its essential components. As a rule, such running gears include two flange rollers 25 and two casters 26.

The exact positioning of such transport units 23 in front of the feed stations 5 is performed in a known manner through the use of sensor devices 39, 40.

The pushers 31 are supported in the chassis 24 of the transport units 23. The pushers 31 have the shovel-like blade 32 and a thrust element 28 and are movable outward toward the feed containers 3 by means of a suitable drive 38 (such as thrust piston mechanisms or spindle drives, etc.). The pushers 31, or at least the shovel-like blades 32, can also be raised and lowered in the vertical direction.

A number of supply containers 27 are disposed on the transport unit 23 and have a U-shaped outline like the feed containers 3, with an open end 29 pointing in the direction of the open-end spinning machine 2. A depression 43 is again provided in the bottom of each supply container 27. The shovel-like blade 32 of the pusher 31, in a retracted, lowered state, rests in this depression.

Function of the Apparatus

As is shown particularly in FIG. 3, the transport unit 23 that can be driven over the rails 21, 22 either retrieves material from a non-illustrated machine (such as a card or drawing frame) preceding it in a production line and transports it to the region of the spinning stations 1, or as is suggested in FIG. 3, the feed material is received in an intermediate storage place 41. In that case, the intermediate storage place 41 can be supplied by a driverless transport vehicle 42, having a construction which is comparable to that of the transport unit 23. However, it is also possible to supply the intermediate storage place 41 through a non-illustrated manually operable transport vehicle, for instance having mechanical pushers.

The transport unit 23, which as already noted above has from 5 to 10 U-shaped supply containers 27, has one of the bunches 6 of sliver 7 in each supply container 27. If a feed container 3 has run empty at a spinning station 1, the transport unit 23 drives up to it and positions one of its full supply containers 27 precisely in front of the empty supply container 3, by means of the sensor device 39, 40. The then-actuated pusher 31, with its shovel-like blade 32, lifts the bunch 6 somewhat and, with its thrust element 28, thrusts it through the discharging opening 29 and through the charging opening 30 into the feed containers 3. During the transfer of the sliver bunch 6, a sliver end 36 is carried along by a manipulator 37 disposed on the pusher 31 and is transferred to the sliver retainer 20 mounted on the feed container 3. The supply containers 27 and the feed containers 3 have widths b being adapted to the widths of the spinning stations.

The pusher 31, or its shovel-like blade 32, is then lowered into the depression 33 of the feed container 3 and retracted into the transport unit 23.

The process of transferring feed material to the spinning station is then completed. The transport unit 23 can then move on to the next empty feed container 3.

At the applicable spinning station, the sliver end 36 is then either manually or automatically taken from the sliver retainer 20 of the feed container 3 and threaded into a feed nozzle 44 of the spinning station. That spinning station can then continue operation.

I claim:

1. In combination with a spinning machine having spinning stations and feed stations at the spinning stations, an apparatus for supplying the spinning machine with feed material, comprising:

a transport unit being movable along the spinning machine for advancing feed material produced by a production machine upstream of the textile machine to a region of the spinning stations;

a supply container disposed on said transport unit for supplying the feed material in the form of a transport-containerless bunch, said supply container surrounding the bunch except for a discharge opening formed in said supply container; and said transport unit having at least one pusher for transferring the feed material to the feed stations.

2. The apparatus according to claim 1, wherein said transport unit furnishes sliver to the spinning stations as the feed material.

3. The apparatus according to claim 1, wherein said transport unit has support surfaces thereon for supporting at least one bunch and from which the bunch is transferred to the feed stations.

4. The apparatus according to claim 1, wherein the feed stations have at least lateral support surfaces.

5. The apparatus according to claim 1, wherein said at least one supply container is U-shaped.

6. In combination with a spinning machine having spinning stations and feed stations at the spinning stations, an apparatus for supplying the spinning machine with feed material, comprising:

a transport unit being movable along the spinning machine for advancing feed material produced by a production machine upstream of the textile machine to a region of the spinning stations;

said transport unit having at least one pusher for transferring the feed material in the form of a transport-containerless bunch, to the feed stations, and feed containers disposed at the feed stations and surrounding the bunch except for a charge opening formed in said feed containers.

7. The apparatus according to claim 6, wherein said feed containers are U-shaped.

8. The apparatus according to claim 6, wherein said feed containers each have a suction device for removing sliver residues.

9. The apparatus according to claim 6, including devices disposed on said feed containers for holding a sliver end in a ready state.

10. In combination with a spinning machine having spinning stations and feed stations at the spinning stations, an apparatus for supplying the spinning machine with feed material, comprising:

a transport unit being movable along the spinning machine for advancing feed material produced by a production machine upstream of the textile machine to a region of the spinning stations;

said transport unit having at least one pusher for transferring the feed material in the form of a transport-containerless bunch, to the feed stations, and supply containers disposed on said transport unit, and feed containers installed at the feed stations in the region of the spinning stations, said supply containers and said feed containers having approximately U-shaped outlines, open ends facing toward one another, and each of said containers having a width adapted to the width of a respective one of the spinning stations.

11. The apparatus according to claim 10, wherein said at least one pusher transfers the bunch in said supply containers to said empty feed containers.

12. The apparatus according to claim 10, wherein said supply containers and said feed containers have yarn-free inner surfaces.

13. The apparatus according to claim 11, wherein said at least one pusher includes a multiplicity of pushers each being associated with a respective one of said supply containers and being extendable outward in the direction of said feed containers.

14. The apparatus according to claim 13, wherein said pushers each have a support element for raising a bunch during expulsion of the bunch from one of said supply containers, and each of said feed containers has a bottom and a depression formed in the region of the bottom into which said support element is lowered upon retraction of said pusher.

15. The apparatus according to claim 11, including a manipulator disposed on said at least one pusher for transferring a sliver end.

16. The apparatus according to claim 11, wherein from 5 to 10 of said supply containers are disposed on said transport unit.

17. In combination with a spinning machine having spinning stations and feed stations at the spinning stations, an apparatus for supplying the spinning machine with feed material, comprising:

a transport unit being movable along the spinning machine for advancing feed material produced by a production machine upstream of the textile machine to a region of the spinning stations;

said transport unit having at least one pusher for transferring the feed material in the form of a transport-containerless bunch, to the feed stations, and supply containers disposed on said transport unit, and feed containers installed at the feed stations in the region of the spinning stations, said supply containers and said feed containers having approximately rectangular outlines, and each of said containers having a width adapted to the widths of the respective spinning stations.

18. The apparatus according to claim 17, wherein said at least one pusher transfers the bunch in said supply containers to said empty feed containers.

19. The apparatus according to claim 18, wherein from 5 to 10 of said supply containers are disposed on said transport unit.

20. The apparatus according to claim 18, wherein said at least one pusher includes a multiplicity of pushers each being associated with a respective one of said supply containers and being extendable outward in the direction of said feed containers.

21. The apparatus according to claim 20, wherein said pushers each have a support element for raising a bunch during expulsion of the bunch from one of said supply containers, and each of said feed containers has a bottom and a depression formed in the region of the bottom into which said support element is lowered upon retraction of said pusher.

22. The apparatus according to claim 18, including a manipulator disposed on said at least one pusher for transferring a sliver end.

23. The apparatus according to claim 17, wherein said supply containers and said feed containers have yarn-free inner surfaces.

* * * * *